United States Patent [19]

Kunz et al.

[11] Patent Number: 4,826,324

[45] Date of Patent: May 2, 1989

[54] KNEADER-MIXER

[75] Inventors: Alfred Kunz, Witterswil; Heinz List; Jörg List, both of Pratteln, all of Switzerland

[73] Assignee: List AG, Pratteln, Switzerland

[21] Appl. No.: 132,433

[22] Filed: Dec. 14, 1987

[30] Foreign Application Priority Data

Dec. 19, 1986 [CH] Switzerland ..... 5102/86

[51] Int. Cl.[4] ..... B01F 7/04

[52] U.S. Cl. ..... 366/99; 366/149; 366/307; 366/309; 366/313

[58] Field of Search ..... 366/65–67, 366/96, 97, 75, 144, 149, 279, 99, 292, 293, 302–307, 309, 149, 312, 313, 315, 317, 325; 422/225

[56] References Cited

U.S. PATENT DOCUMENTS

| | | | |
|---|---|---|---|
| 2,204,029 | 6/1940 | Russell | 366/313 X |
| 2,804,379 | 8/1957 | Wistrich et al. | 366/305 X |
| 3,650,319 | 3/1972 | Boon | 366/307 X |
| 4,279,295 | 7/1981 | Duckworth | 366/312 |
| 4,413,913 | 11/1983 | Hold et al. | 366/315 |
| 4,650,338 | 3/1987 | List et al. | 366/97 |

*Primary Examiner*—Timothy F. Simone
*Attorney, Agent, or Firm*—Helfgott & Karas

[57] ABSTRACT

A kneader-mixer performs mechanical, thermal and/or chemical processes with products which are in the liquid, viscous-pasty and/or free flowing state and includes an elongated hollow casing having an axis of elongation and having axially separated product inlet and product outlet ports. The casing has an inner wall. A kneading shaft in the casing is aligned with the axis and is rotatable thereabout. A plurality of kneading arms secured to the shaft extend radially outward therefrom in the casing. The arms are spaced axially along the shaft. A plurality of flat disc elements are disposed in the casing and lie in spaced parallel planes disposed at right angles to the shaft. Each element defines a circular sector spaced from the shaft and is secured to the inner wall of the casing. Each element is disposed adjacent a kneading arm which cleans the adjacent surface of the element as the shaft rotates. Each disc has secured thereto in a position adjacent but spaced from the shaft a corresponding axially extending kneading counter element. The counter elements are spaced from each other and, as the shaft rotates, function as shaft scraping blades as well as carrying out axial and radial product transfer. Each kneading arm passes between two adjacent counter elements. Each counter element has at each end a radially extending lateral edge which cleans the lateral face of the adjacent kneading arm as the shaft rotates.

20 Claims, 9 Drawing Sheets

KNEADER-MIXER

BACKGROUND OF THE INVENTION

The invention relates to a kneader-mixer for performing mechanical, thermal and/or chemical processes. Kneader-mixers of this type are e.g. known from Austrian Pat. No. 294020 and Swiss Pat. No. 410789. In these known kneader-mixers a kneading shaft with vertically fitted disk elements is cleaned on radial kneading counterelements fixed in the casing, the kneading shaft with the disk performing an axial reciprocating movement to ensure good cleaning. The time involved in this reciprocating movement leads to poor cleaning of the heat transferring surfaces, i.e. to an inadequate heat exchange and an inadequate kneading action, despite high energy expenditure. In another kneader-mixer according to German Pat. No. 23 49 106 the heat transferring disks are also fixed to the shaft and are cleaned by hooks during a rotary movement, a good kneading action being obtained through the co-operation between mixing bars on the disks and the hooks fixed in the casing. The disadvantage of this arrangement with regards to certain products is the formation of toroidal product accumulations between the disks, which greatly inhibit the movement of material between said disks.

SUMMARY OF THE INVENTION

It is an object of the present invention to intensify the kneading action, energy costs and prevent torus formation. Another object is to improve the heat exchange action through a better cleaning of all heat transferring surfaces. Another object is to obtain manufacturing advantages through the simplification of the casing and shaft.

A kneader-mixer for performing mechanical, thermal and/or chemical processes with products which are in the liquid, viscous-pasty and/or free flowing solid state, in accordance with the invention, includes an elongated hollow casing having an axis of elongation and having axially separate product inlet and product outlet ports. The casing has an inner wall. A kneading shaft in the casing is aligned with the axis and is rotatable thereabout. A plurality of kneading arms secured to the shaft extend radially outward therefrom in the casing. The arms are spaced axially along the shaft. A plurality of flat disc elements are disposed in the casing and lie in spaced parallel plans disposed at right angles to the shaft. Each element defines a circular sector spaced from the shaft and is secured to the inner wall of the casing. Each element is disposed adjacent a kneading arm which cleans the adjacent surface of the element as the shaft rotates. Each disc has secured thereto in a position adjacent but spaced from the shaft a corresponding axially extending kneading counter element. The counter elements are spaced from each other and, as the shaft rotates, function as shaft scraping blades as well as carrying out axial and radial product transfer. Each kneading arm passes between two adjacent counter elements. Each counter element has at each end a radially extending lateral edge which cleans the lateral face of the adjacent kneading arm as the shaft rotates.

In certain specific structures in accordance with the invention, a good mixing action, particularly in the case of free-flowing products, is obtained, gravity always returning the product into the outer mixing area. Up to now the kneading elements and counterelements necessary for a good action were missing there for viscous-pastry products. These structures overcome these disadvantages through a special construction of the kneading elements and counter elements.

The foregoing as well as additional objects and advantages of the invention will either be explained or will become apparent to those skilled in the art when this specification is read in conjunction with the brief description of the drawings and the detailed description of preferred embodiments which follow.

DETAILED DESCRIPTION OF THE PREFERRED EMBODIMENTS

Figure 1:
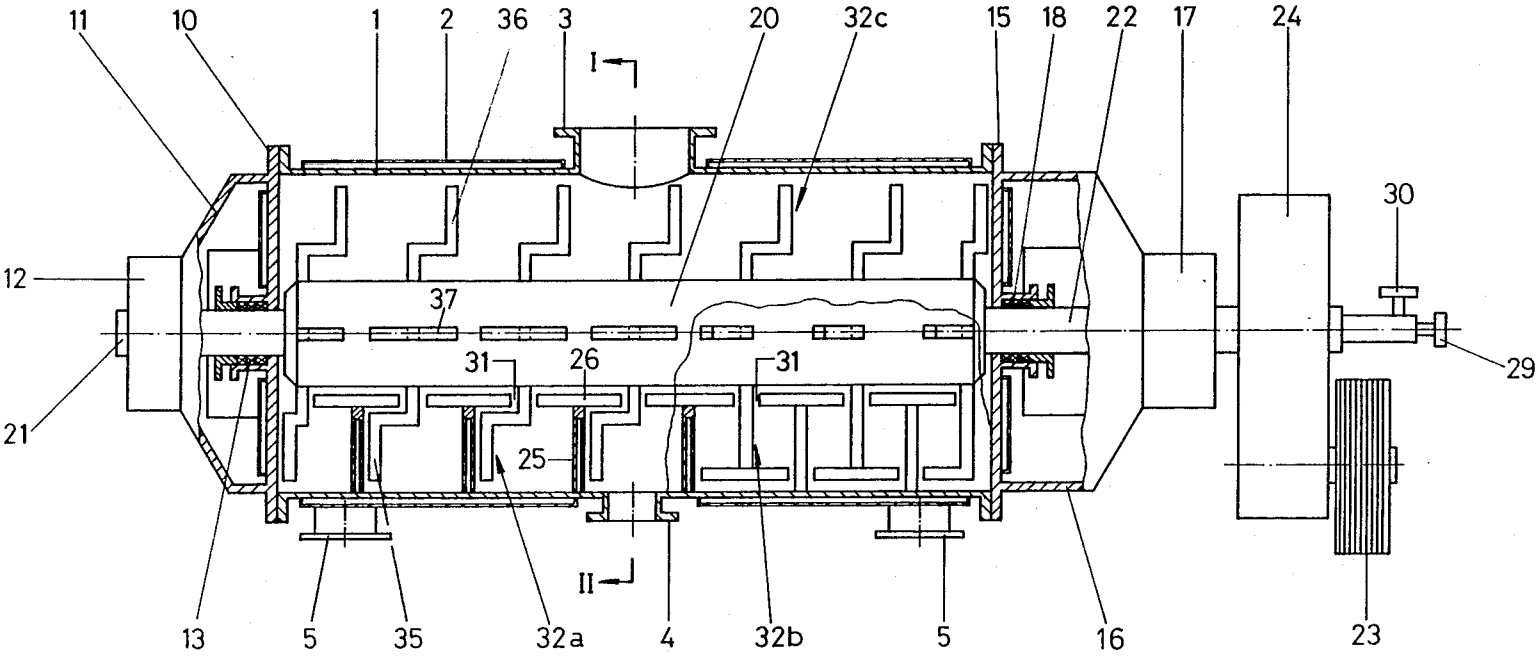
FIG. 1 is a longitudinal section through the casing of a kneader-mixer along line III—IV of FIG. 2
Figure 2:
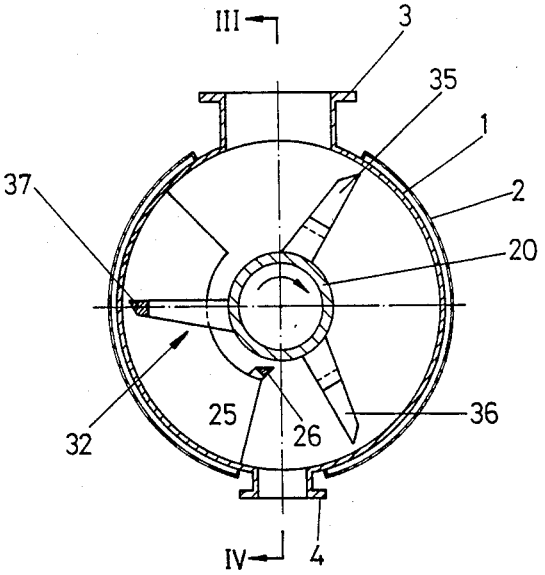
FIG. 2 is a cross-section through the kneader-mixer along line I—II in FIG. 1.

The basic principle of the invention is shown in FIGS. 1 and 2. In a mainly horizontally arranged casing 1 with disk elements 25, end walls 10 and 15, shaft 20 with kneading arms 32 rotates.

Casing 1 is provided with a heating jacket or heating ducts 2. For filling the starting product and for drawing off vapours, one or more connections 3 are provided at the top. The emptying of the completely treated product takes place at the lower connection 4. The feet 5 are provided for supporting the apparatus. An end wall 15 is equipped with the stuffing box 18 and connected to cage 16 for supporting bearing 17 for stirring shaft journal 22. End wall 10 with stuffing box 13, cage 11 and bearing 12 on the axially facing side have a similar construction. Central shaft 20 with shaft journals 21 and 22 are supported in bearings 12 and 17 and is driven by a not shown drive motor via V-belt pulley 23 and slip-on gear 24.

Kneading arms 32 are arranged on shaft 20 and to said arms are attached kneading, stirring and transfer elements 35, 36, 37. Shaft 20 is normally heatable and coolable, the supply of the heating and cooling medium taking place through connection 29 and the return by connection 30.

Disk elements 35 have kneading counterelements 26, which are constructed in such a way that there is always a gap or space 31 between their ends. In the vicinity of said gap, the adjacent cylindrical shaft part is not covered by the kneading counterelements 26, which makes it possible to fit there powerful kneading arms 32 to the shaft.

The kneading counterelements 26 arranged on disk elements 25 are axially arranged in such a way that they strip and clean shaft 20 and kneading arms 32. Through the rotation of shaft 20, the product is rubbed against disk elements 25 by means of kneading arms 32 and for increasing the kneading action is pressed through the gap between the kneading shaft and the axial part of the kneading arm 32 by means of the kneading counterelements 26. In addition to the improvement of the kneading action, the kneading elements 26 also clean the heatable and coolable surfaces of the kneading shaft with the kneading arms 32 arranged thereon.

Figure 3:
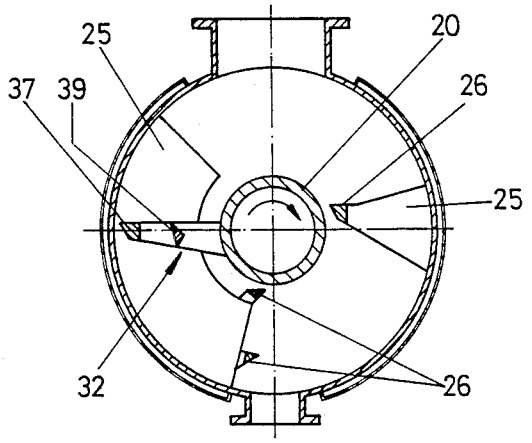
FIG. 3 is a half cross-section of another embodiment of a kneader mixer.

FIG. 3 e.g. shows an arrangement of the kneading counterelements 26 on disks 25, which are used for transferring or transporting the product from the shaft against the actual kneading gap between casing 1 and the kneading, stirring and transfer elements 37, 39 of kneading arm 32. Instead of only having one row of kneading counterelements 26 in casing 1, it is also possible to have two or more rows on different rotation radii.

These kneading counterelements 26 which, in the rotation direction of shaft 20, are successively fixed to the disk elements 25 can have different constructions, e.g. one kneading counterelement may only project to the left when viewed from the mounting support, while the second kneading counterelement correspondingly projects to the right. There are also numerous variants for the shape of the kneading counterelements. They can have a large surface, be knife-like or frame-like, as is shown in the attached drawings. Often the kneading action can be improved through the appropriate shape of the kneading, stirring and transfer elements in conjunction with the shaping of the kneading counterelements, e.g. through a wedge-shaped reduction of the passage cross-section in the kneading gap of the two tools.

Figure 4:
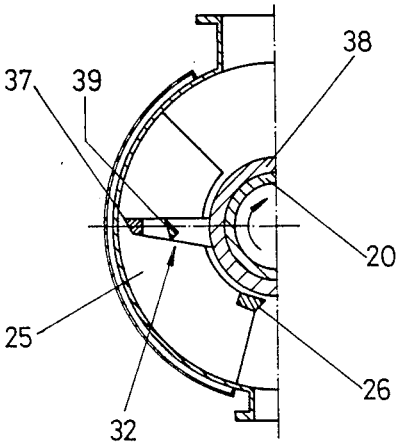
FIG. 4 is a half cross-section of another embodiment of a kneader-mixer.

Numerous variants are also possible for the disk elements. Apart from the chosen number of kneading arm or their kneading, stirring and transfer elements, the dimensions and shapes, importance is attached to one construction in accordance with FIG. 4, where the kneading arms 32 are arranged on special supports 38, such as e.g. pipe clips, spacing sleeves, shims, etc. This permits simple disassembly, as well as a subsequent simple replacement and adaption of the kneading arms to the particular product quality.

Figure 5:
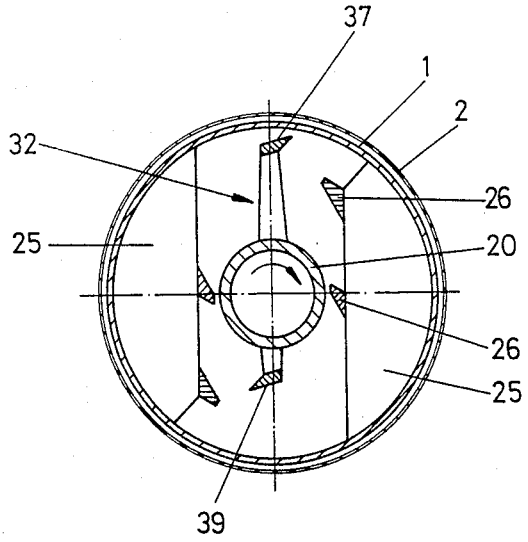
FIG. 5 are cross-sections through further embodiments of kneader-mixers to 7.

In order to show a further arrangement of the disk elements 25 and the kneading arms 32 or kneading, stirring and transfer elements 37, 39, FIG. 5 shows a cross-section through a disk zone of the kneader-mixer with two rows of varying long kneading arms and the correspondingly constructed kneading counterelements on the disks, as well as per disk plane two upright disk elements, between which is left a large passage opening for axial product and gas transfer. This construction also has the advantage that the casing can be easily removed.

Figure 6:
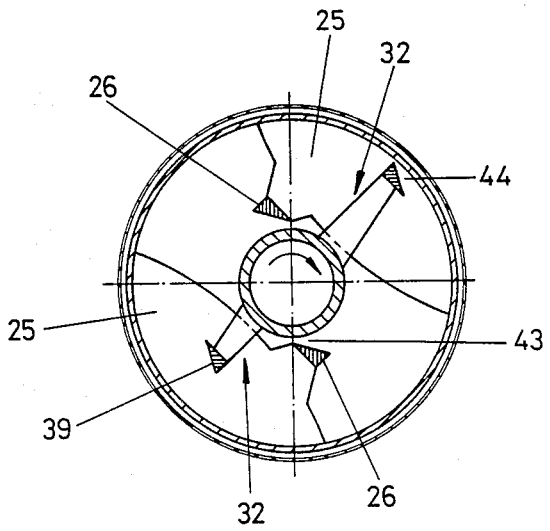

FIG. 6 shows the construction of a kneader-mixer, where the kneading elements 37, 39 and kneading counterelements 26 are arranged in such a way that the kneading gaps 43 and 44 are formed opposite shaft 20 and kneading counterelements 26, as well as between kneading elements 37 and casing 1.

Figure 7:
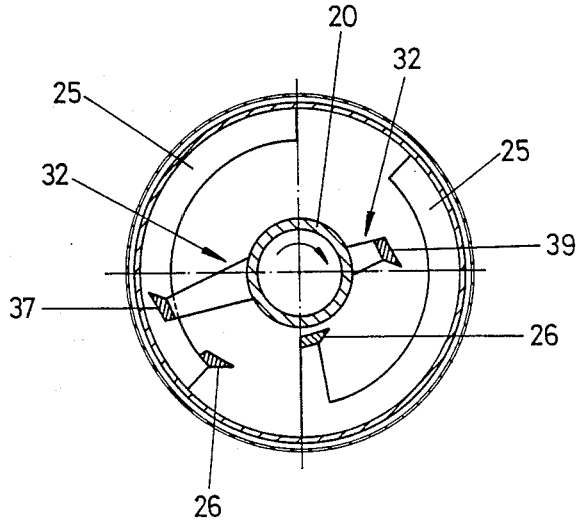

FIG. 7 shows a construction in which the disk elements 25 are arranged in such a way that their entire surface is only heated by heat conduction, which reduces the cost of manufacture and facilitates assembly. In the case of an adequate heat exchange surface of the casing, the disk elements 25 are so reduced in a size that they only form support elements for the kneading counterelements 26.

Figures 8, 9:
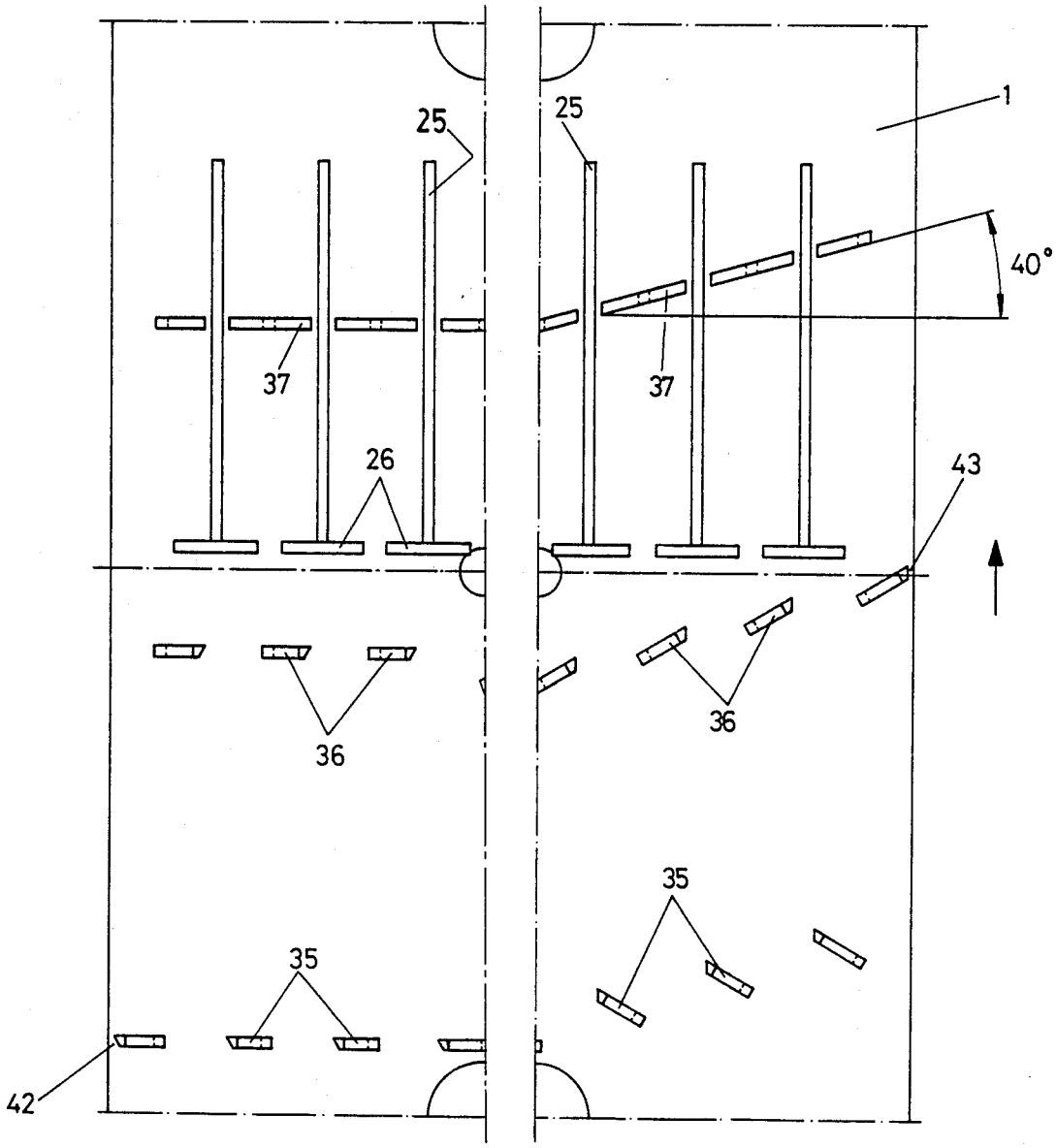
FIG. 8 is a development of part of a kneader-mixer for showing the arrangement of the kneading, stirring and transfer elements in accordance with FIG. 2.
FIG. 9 is a representation corresponding to FIG. 8 of another embodiment of the arrangement.
Figure 10:
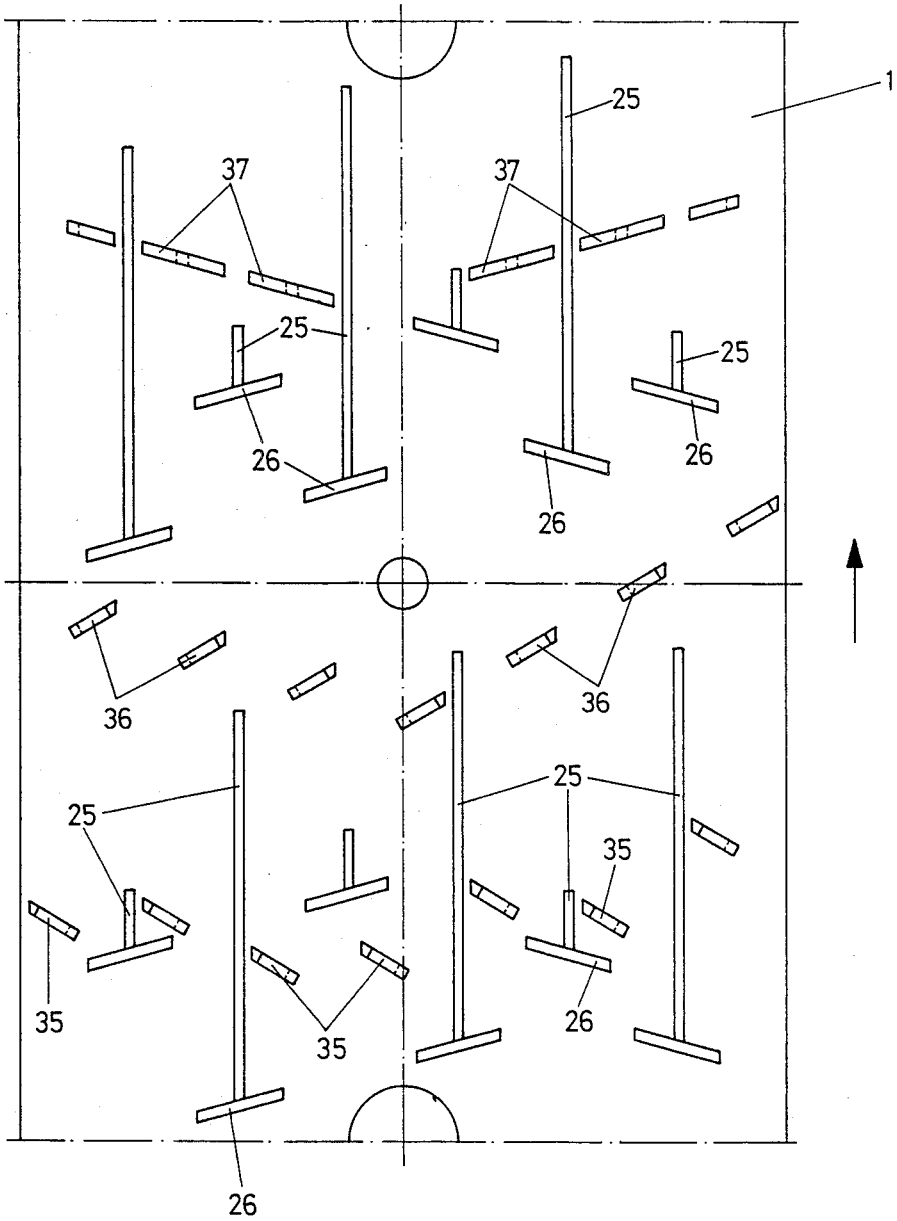
FIG. 10 is a representation corresponding to FIG. 8 or 9 of another embodiment of the arrangement according to FIG. 3.

FIGS. 8, 9 and 10 show some of the many possible arrangements of kneading arms 32 and kneading counterelements 26 in a development. In the latter, the cylindrical casing 1 is cut open at the top and is flapped down in one plane. Correspondingly the outer circumference of disk elements 25 is projected on said plane.

FIG. 8 shows half of a machine, in which all the disk elements are at right angles to the axial longitudinal line of the shaft, the kneading counterelements 26 and the kneading, stirring and transfer elements 35, 36, 37 being precisely axially fitted.

Better than the aforementioned arrangement is in most cases the arrangement according to FIG. 9, in which the kneading arms 32 are no longer located on a precisely axial line and are instead located on a line corresponding to the transfer angle 40 of the kneading, stirring and transfer elements 37, which has the advantage that product transfer is facilitated.

In FIG. 9 the kneading counterelements 26 are also at an angle to the axial casing axis, which in fact opposes the transfer angle 40 of the kneading, stirring and transfer elements. The kneading action of the system can be improved by this shear-like engagement.

The system according to FIG. 10 shows an example of the way in which it is possible to considerably reduce product accumulations and the compacting effect resulting therefrom. The arrangement of the kneading arms and disk elements or the kneading, stirring and transfer elements and kneading counterelements has been chosen in such a way that a plurality of elements is never simultaneously in engagement with one another. This function is also fulfilled by the displacement of the disk elements on the right by a specific inscribed angle with respect to those on the left.

Figure 11:
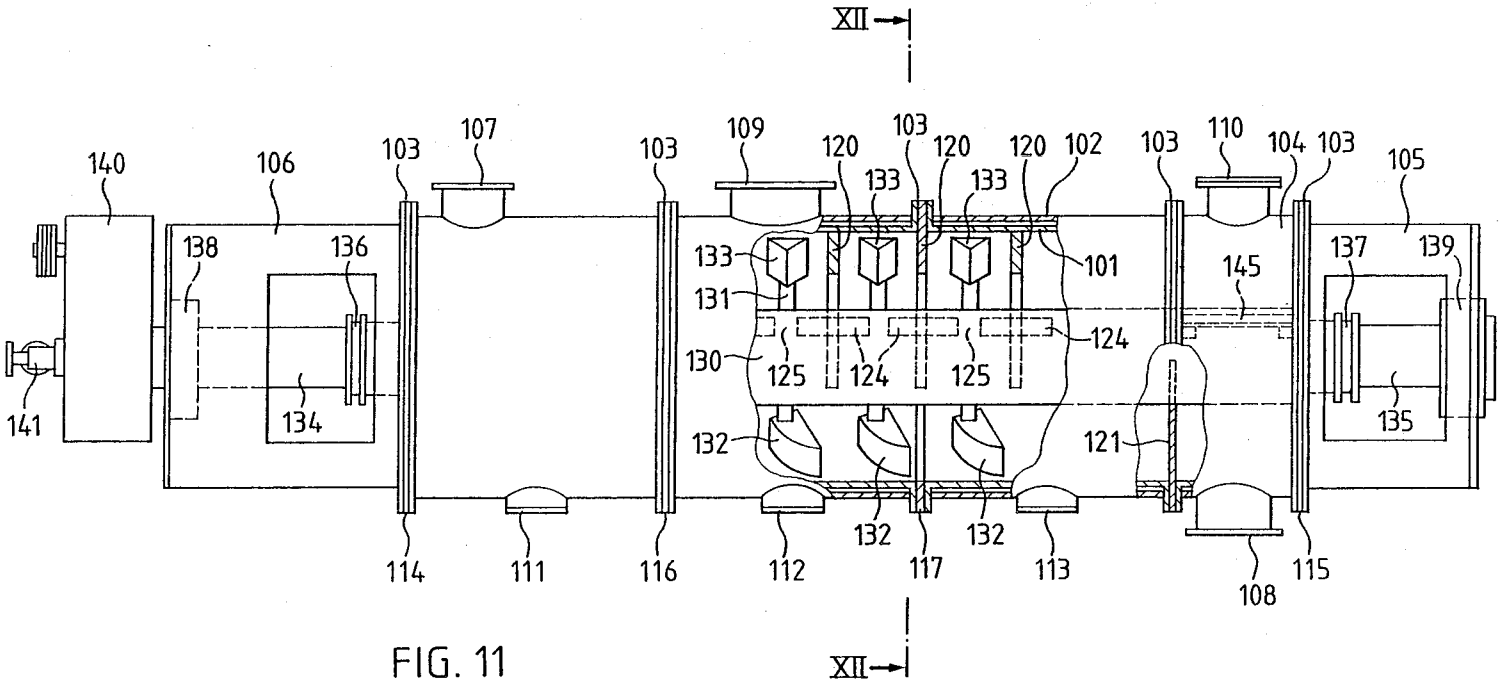
FIG. 11 is an overall view of another embodiment of a kneader-mixer with partial longitudinal section along section lines XI—XI in FIG. 2.
Figure 12:
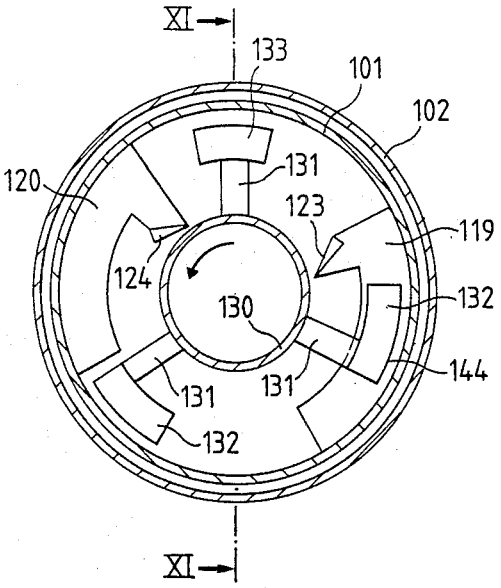
FIG. 12 is a cross-section through the kneader-mixer along section lines XII—XII*l* in FIG. 11.

In the case of a kneader-mixer for continuous operation according to FIG. 11, the actual working area in casing 101 surrounded by a heating jacket or heating ducts 102 is constructed in three parts. The individual casing parts are interconnected by flange connections 103. Using similar detachable flange connections an outlet casing 104, a bearing cage 105 and a drive cage 106 are screwed to the working casing.

On casing 101 or outlet casing 104 are arranged a filling connection 107, an outlet connection 108, a vapours connection 109 and a cleaning and observation connection 110. Connections 111, 112 and 113 are used as emptying connections. At both ends of the product area in the represented construction the end walls 114 and 115 are secured in the flange connection, while 116 and 117 are sheet metal rings, in which are fixed disk elements 119 and 120 as kneading counterelements.

A level plate 121 regulating the product height in the kneader-mixer is fixed to the flange connection between the kneader casing and the outlet casing. The sheet metal rings 116 and 117 are either held by the flange connections 103 or as disk elements 119, 120 are welded or screwed directly into the casing 101. Along the kneading shaft, each disk element is provided with the axially projecting kneading counterelements or shaft scrapers 123, 124, between which is in each case provided a gap 125, in order to permit the passage of the kneading arms 131 fixed to the kneading shaft 130. The disk elements can also be constructed as a ring, which projects from the inner wall into the interior of the casing. The kneader-mixer comprises the kneading shaft 130, to which are fixed kneading elements 132 and transfer elements 133 by means of kneading arms 131.

Figure 13:
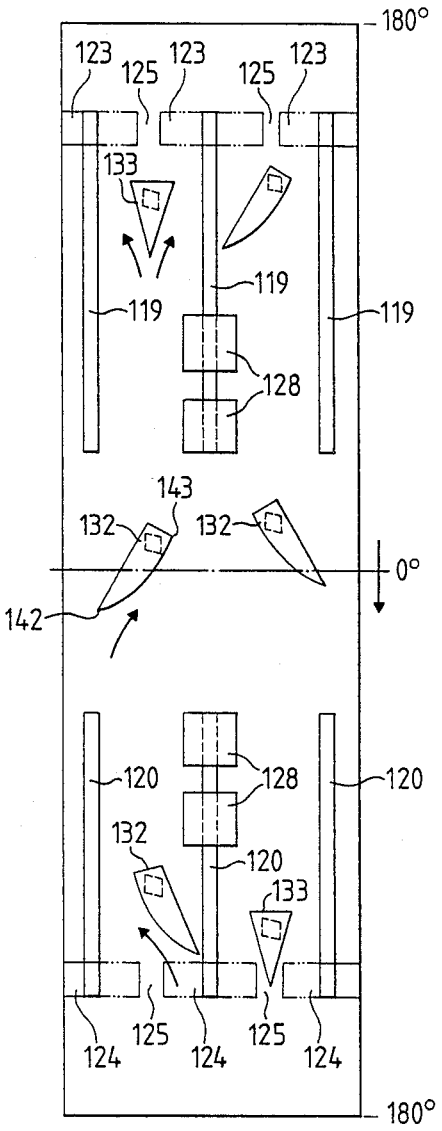
FIG. 13 is a development of the kneader-mixer according to FIGS. 11 and 12.

The drive and bearing shaft journals 134, 135 are placed on the ends of kneading shaft 130. The stuffing boxes 136, 137 seal the shaft passage against the production area. The entire kneading shaft 130 is supported in bearings 138, 139 and driven by an electric motor by means of a gear 140. The forward and return travel of the heating medium for heating the kneading shaft takes place by means of a slip ring sealing head 141. In the present case, each kneading element is provided with a scraping edge 142, an axial scraping edge 144 and a kneading gap face 143 (cf. FIG. 13). When kneading elements 132 pass the disk elements 119, 120 as kneading counterelements, the scaped product is subject to a powerful kneading action in known manner.

The product fed into connection 107 is taken up by the kneading elements 132 and is alternately subject to a strong kneading action between facing disk surfaces. As soon as the product level has reached the kneading shaft, it is taken up by the shaft scrapers 123, 124. Although not shown, in the present case the scraper blades are inclined and as a result of this inclined position the material is axially transferred through the individual kneading areas between the disk faces of the machine. As soon as the product level is reached in the entire machine, the product drops over the upper edge of the level plate 121 into the outlet casing 104 and is supplied there by a frame-like stirring beam 145 to the outlet connection 108. Transfer elements 1333 ensure that the product pressed backwards and forwards by the kneading elements 132 between the facing disk surfaces is again uniformly distributed over the two disk surfaces as kneading counterelements. The presently shown transfer elements 133 can also be constructed as surfaces inclined in one direction and then served as additional axially acting transfer elements for the products through the machine. Such transfer elements also permit a material return into the machine.

Figure 14:
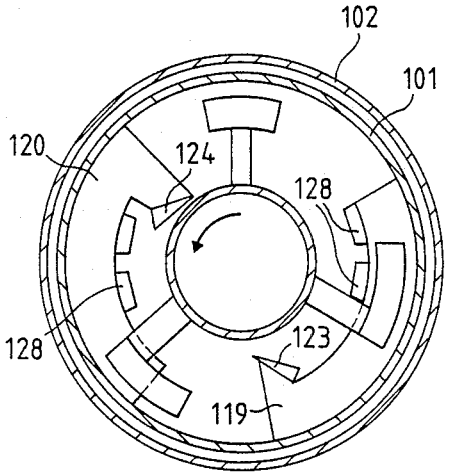
FIG. 14 is a cross-section through a kneader-mixer with another arrangement of the shaft scrapers and inner collecting plates for constricting the kneading area.

The cross-section of FIG. 14 shows another arrangement of the shaft scrappers 123, 124, an increased kneading action resulting from the position of scraper 123, which presses the product into the space between two scraping faces.

Figure 15:
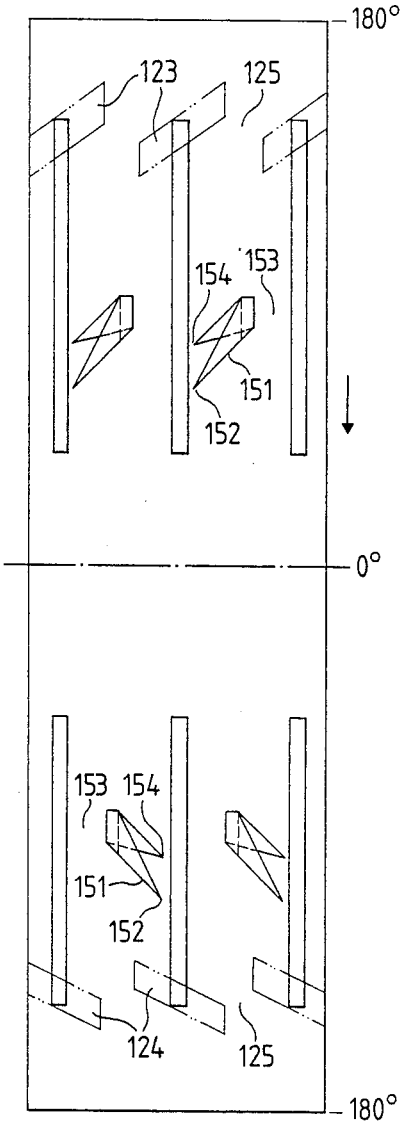
FIG. 15 is a development of a kneader-mixer with multisurface kneading elements and inclined shaft scrapers for axial transfer or transport.

This kneading action can be further increased in that individual areas of the disk elements 119, 120 prevent any inward deflection of the product through axially projecting collection plates 128 (cf. also FIG. 15). This leads to a constriction of the cross-section on passing through the kneading elements and to an increased kneading action.

Figure 16:
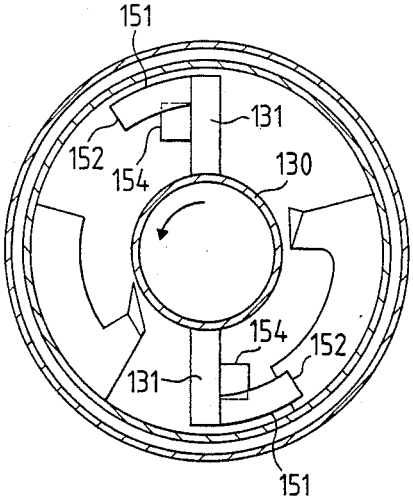
FIG. 16 is a cross-section through a kneader-mixer with multisurface kneading elements.
Figure 17:
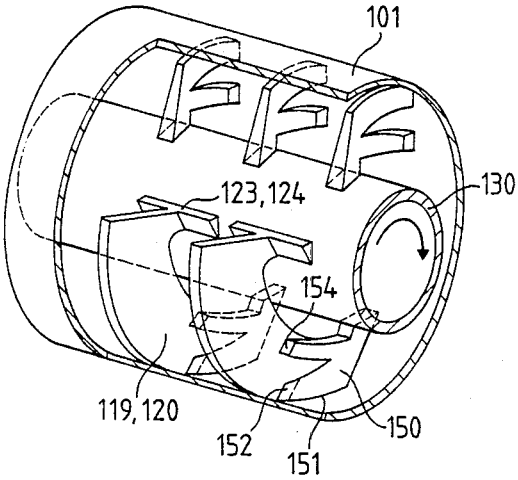
FIG. 17 is a perspective view of a multisurface kneading element.

In the development according to FIG. 15, the associated cross-section according to FIG. 16 and the perspective view of FIG. 17, shaft scrapers 123, 124 are inclined, in order to ensure the axial transfer of the product through the machine. In this construction, the kneading elements 150 are constructed as multisurface kneading elements, the inner wall of the casing 1 being cleaned by scraping by scraping edge 151 and then the outer part of the disk elements connected to the inner wall are cleaned by scraping edge 152.

The product deflection surface belonging to the scraping edges pass the scraped product directly into the kneading gap 153 against the facing disk elements surface. The inner part of the disk elements is cleaned by edge 154.

Through the associated disk surface, the product is defected further inwards against the kneading shaft and is taken up there by the corresponding shaft scrapers as kneading counterelements. The shaft scrapers are often shaped in such a way that they serve as kneading counterlements for the scraper 154. The principal of the multisurface scraper can also be realized in another form. The principle is characterized by subdividing the product into various product flows, which are then remixed by the following kneading elements.

Figure 18:
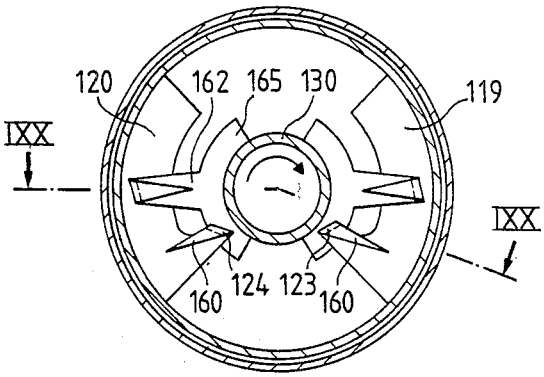
FIG. 18 is a cross-section through a kneader-mixer with fork shaped kneading elements and corresponding fixed kneading elements on the shaft scrapers, as well as the construction of the supports for rotary kneading elements as disk elements.
Figure 19:
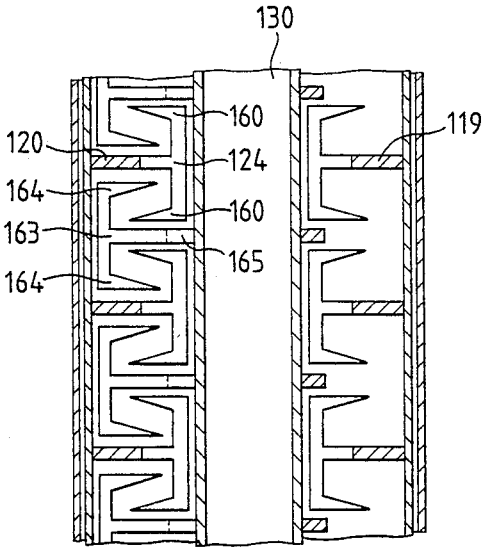
FIG. 19 is a part longitudinal section of the construction along section lines IXX—IXX in FIG. 18.

The cross-section according to FIG. 18 and the partial longitudinal section according to FIG. 19 show a construction with a fork-shaped kneading element and a correspondingly shaped kneading counterelement, which is in particular characterized by the radial parts 160 mounted on the shaft scrapers. The kneading elements are connected to the kneading shaft 130 by means of supports constructed as disk elements 165 and comprise the partly disk-shaped, radial kneading arms 162 with the axial arms 163 along the inner wall of casing 101, to which the radial kneading bars 164 are fixed along the fixed disk elements. On the passage of the kneading elements engaging in fork-like manner into the kneading counterelements (disks 119, 120 and 160), good mixing and kneading effects are obtained, together with good cleaning of the kneading counterelements. For increasing the heat transfer surface, in the present case the kneading arms 162 are constructed in the vicinity of kneading shaft 130 as heat transferring, disk-shaped ring segments, which are continuously cleaned by the fixed radial kneading counterelements 160. These kneading elements car also have a one-sided construction and then between the disk surfaces one kneading element cleans one fixed disk surface, while a second kneading element cleans the opposite disk surface. In a ring-like construction, supports 165 can completely surround the kneading shaft 130.

The presently shown realizations of the invention can be varied in many different ways. For example, several kneading element types can be arranged in one machine. If this is allowed by the reciprocal engagement of kneading element and kneading counterelement, the kneading elements can be constructed with offset, twisted shapes.

The same principles are applied for batchwise operation of a kneader-mixer. However, in this case the transfer elements are chosen in such a way that the product circulates in two circles in the machine, thre firstly being an axial transfer from the centre to the outside and then back again in known manner.

While the invention has been described with detailed reference to the drawings, it will be obvious to those skilled in the art that many modifications and changes can be made within the scope and sphere of the invention as defined in the claims which follow.

What is claimed is:

1. A kneader-mixer for performing mechanical, thermal and/or chemical processes with products which are in the liquid, viscous-pasty and/or free flowing solid state, said kneader mixer comprising:

an elongated hollow casing having an axis of elongation and having axially separated product inlet and product outlet ports, said casing having an inner wall;

a kneading shaft in the casing aligned with the axis and rotatable thereabout;

a plurality of kneading arms secures to the shaft and extending radially outward therefrom in the casing, said arms being spaced axially along the shaft;

a plurality of flat disc elements in the casing which lie in spaced parallel planes disposed at right angles to the shaft, each element defining a circular sector spaced from the shaft and being secured to the inner wall of the casing, each element being disposed adjacent a kneading arm which cleans an adjacent surface of the element as the shaft rotates;

each disc having secured thereto in a position adjacent but spaced from the shaft a corresponding axially extending kneading counter element, the counter elements being spaced from each other and, as the shaft rotates, functioning as shaft scraping blades as well as carrying out an axial and radial product transfer, each kneading arm passing between two adjacent counter elements, each counter element having at each end a radially extending lateral edge which cleans a lateral face of the adjacent kneading arm as the shaft rotates.

2. Kneader-mixer according to claim 1, wherein the kneading arms are arranged along at least one row in the direction of the axis of elongation.

3. Kneader-mixer according to claim 1, wherein the kneading arms are longitudinally displaced with respect to a surface line of the cylinder of revolution of the shaft.

4. Kneader-mixer according to claim 1 wherein several of the kneading arms differ in shape and also in spacing from said shaft.

5. Kneader-mixer according to claim 4, wherein the kneading arms are adapted to a particular shape of the disc elements, the casing inner wall and the counter elements.

6. Kneader-mixer according to claim 1, wherein at least two rotary kneading arms are fixed to said shaft in the direction of the axis of elongation between in each case two disc elements, whereof in each case one kneading arm only passes along one disc element and part of a casing surface, whereas a second kneading arm passes along the facing disc element and the remainder of the casing surface between said two disc elements.

7. Kneader-mixer according to claim 1 wherein at least one kneading arm is moved between the counter elements.

8. Kneader-mixer according to claim 1 wherein the kneading arms are provided with kneading, stirring and transfer elements.

9. Kneader-mixer according to claim 8, wherein the kneading, stirring and transfer elements are arranged at an angle to the axis of the casing in order to promote the transfer of the product to be treated through the kneader-mixer.

10. Kneader-mixer according to claim 8 wherein several kneading, stirring and transfer elements are provided on one kneading arm.

11. Kneader-mixer according to claim 10 wherein the kneading arms are arranged on supports which are detachable and interchangeably fixed to the shaft.

12. Kneader-mixer according to claim 11, wherein the shaft scraping blades are fixed along the shaft and are inclined with respect to an axis of said shaft for the axial transfer of product.

13. Kneader-mixer according to claim 12, wherein the scraping blades project axially of the shaft, are internally fixed to the disc elements and are provided with surfaces, which are inclined with respect to radii passing through a center of the kneading shaft for the radial transfer of the product.

14. Kneader-mixer according to claim 12 wherein for increasing the kneading action, the disc elements are provided on an inner movement circle of the kneading elements with axially projecting collecting plates so that a kneading space through which the kneading elements pass is also inwardly constricted.

15. Kneader-mixer according to claim 12 wherein the kneading elements fixed with the kneading arms to the kneading shaft are constructed in such a way that they have on an external diameter scraping edges for cleaning the inner wall of the casing, radial scraping edges for cleaning the fixed disc elements and a radial surface with which the product scraped from the inner wall of the casing and the disc elements is passed against an opposite disc element into a radial kneading gap.

16. Kneader-mixer according to claim 12 wherein the kneading elements are provided on the kneading arms with at least two scraping edges which separately scrape individual areas of the casing inner wall and the disc surfaces, the deflection surfaces for the product belonging to different scraping edges being arranged in such a way that scraped product streams are divided in different directions and are again intermixed, at least one of the deflecting surfaces forming a kneading gap with one of the fixed disc elements and the casing inner wall.

17. Kneader-mixer according to claim 12 wherein each kneading element on the kneading shaft comprises a radial kneading arm, an axial scraper along the casing inner surface and fixed thereto radial kneading bars extending from the outside to the inside for cleaning the disc elements and the associated kneading counter element engages as a radial arm fixed to the shaft scraping blades between the kneading arm and the kneading bars of the kneading element.

18. Kneader-mixer according to claim 17, wherein a support for the rotary kneading elements on the kneading shaft is constructed as a disc for increasing a heat transfer surface.

19. Kneader-mixer according to claim 18, wherein between the kneading elements on the kneading shaft are arranged transfer elements, which clean the casing inner wall and have transfer surfaces, which are inclined with respect to axial surface lines of the casing.

20. Kneader-mixer according to claim 17, wherein a support for the rotary kneading elements on the kneading shaft is constructed as a disc ring element for increasing a heat transfer surface.

* * * * *